United States Patent [19]

Baillie

[11] 4,195,867

[45] Apr. 1, 1980

[54] DOOR LATCH

[76] Inventor: William R. Baillie, 7082 Kinnikinnick, Roscoe, Ill. 61073

[21] Appl. No.: 810,359

[22] Filed: Jun. 27, 1977

[51] Int. Cl.[2] ..... E05C 1/10

[52] U.S. Cl. ..... 292/174; 292/153; 292/169; 292/175; 70/81; 70/150

[58] Field of Search ..... 292/175, 174, 163, 164, 292/145, 146, 169, 153, 41, 42, DIG. 30, DIG. 38; 85/80; 70/81, 150

[56] References Cited

U.S. PATENT DOCUMENTS

| | | | |
|---|---|---|---|
| 127,027 | 5/1872 | Clark | 292/175 |
| 152,009 | 6/1874 | Robinson | 292/175 |
| 1,152,116 | 8/1915 | Magoveny | 292/175 |
| 1,564,953 | 12/1925 | Gertsfeld | 292/153 |
| 1,601,482 | 9/1926 | Sutherland | 292/175 X |
| 2,503,192 | 4/1950 | Cerf, Jr. | 292/153 |
| 2,900,204 | 8/1959 | Pelcin | 292/153 X |
| 3,469,875 | 9/1969 | Ahlgren | 292/175 |
| 3,611,861 | 10/1971 | Schulze | 85/80 X |
| 3,830,535 | 8/1974 | Read et al. | 292/DIG. 38 X |
| 4,075,924 | 2/1978 | McSherry et al. | 85/80 X |

FOREIGN PATENT DOCUMENTS

| | | | |
|---|---|---|---|
| 2600396 | 7/1976 | Fed. Rep. of Germany | 292/175 |
| 213896 | 11/1966 | Sweden | 85/80 |

*Primary Examiner*—William E. Lyddane

*Attorney, Agent, or Firm*—Silverman, Cass & Singer, Ltd.

[57] ABSTRACT

A door latch particularly for use in mobile homes or recreational vehicles. A housing having a channel formed therein is mounted on one surface of a door overlying a passageway therethrough. A spring-loaded slidable latch engagement member is positioned within the channel for operating engagement with a striker plate mounted on the jamb of the frame against which the door abuts when closed. A latch retaining pin is positioned through the housing and has a shaft part extending within the passageway in the door for receipt on the other side of the door surface of an operating knob or handle secured thereon. Rotation of the operating knob actuates the pin to disengage the latch engagement member and thereby unlatch the door. A lockable abutment member may be positioned upon the door surface or an extension part of the housing to block the path of the latch engagement member when moved toward disengagement position and thereby prevent such disengagement.

In an alternate embodiment a concealed latch is disclosed in which the latch engagement member has a lateral extension disposed in a space formed in the door and opening to the door edge such that a force applied to the extension member will disengage the latch engagement member.

11 Claims, 15 Drawing Figures

DOOR LATCH

BACKGROUND OF THE INVENTION

1. Field of the Invention

This invention relates generally to door latches and more particularly, to spring-loaded latches for use in mobile homes, recreational vehicles or the like having confined spaces in which such latches are to be used.

2. Description of the Prior Art

The confined and congested spaces in mobile homes, recreational vehicles and the like are such that it is desirable and may even be essential to provide cabinet and door hardware for use therein as compact members which take up as little space as possible in the locations in which they are installed. Further, the nature of mobile homes and recreational vehicles in that they often are used for travel is such that it is desirable to design all equipment, including the hardware used therein, as light-weight members which do not add unnecessarily to the load or total weight of such homes or vehicles.

Further, safety requirements make it desirable to have cabinet and door hardware members which do not protrude excessively into the useable spaces of such homes and vehicles thereby eliminating the danger of injury resulting from contact by a person with such members. Cabinet and door hardware members which are concealed and do not protrude at all from the surfaces upon which they are mounted are highly desirable because they completely eliminate the chances of injury from inadvertent contact with such members.

In addition to the above considerations, such cabinet and door hardware preferably should be economical of manufacture and easily assembled and repaired in the event of malfunction.

SUMMARY OF THE INVENTION

The invention is characterized by a door latch having a housing mountable on a surface of a cabinet or room door having a passageway opening to said housing. The housing has a channel formed therein for slidable receipt of a latch engagement member with a latch protrusion for engagement with a striker plate mounted on the jamb of the frame against which the door abuts when closed. A retaining pin is positioned through the housing and disposed for contact with the latch engagement member. The pin has means formed thereon to captivate the same within the housing. A spring is disposed between an abutment surface within the housing and the latch engagement member to bias the latch engagement member out of the housing; the latch engagement member is prevented from leaving the housing by the said retaining pin. Latch disengagement means are associated with the latch engagement member to enable movement of said member against the spring and thereby unlatch the member from the striker plate to permit opening of the door.

In one embodiment of the invention the latch disengagement means comprise a knob operable on a shaft part of the retaining pin which extends within the door passageway. In a second embodiment the latch disengagement means comprise a lateral extension of said latch engagement member disposed in a space formed in the door and opening to the edge thereof.

A lockable abutment member alternatively may be positioned in the path of the latch engagement member to block movement thereof when the same is operated toward the disengagement position.

DESCRIPTION OF THE PREFERRED EMBODIMENTS

Figure 1:
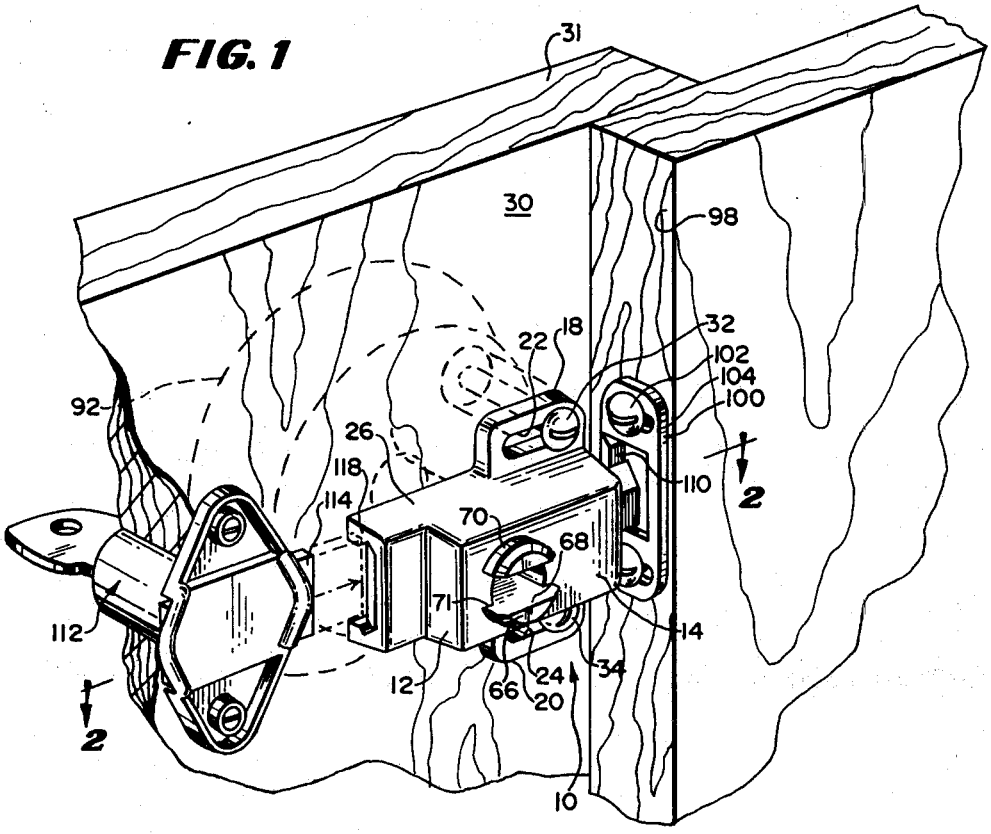
FIG. 1 is a perspective view, partially fragmentary, of a door and jamb with one form of the latch of the invention installed thereon, there also being illustrated a key locking member operable in conjunction with said latch.
Figure 2:
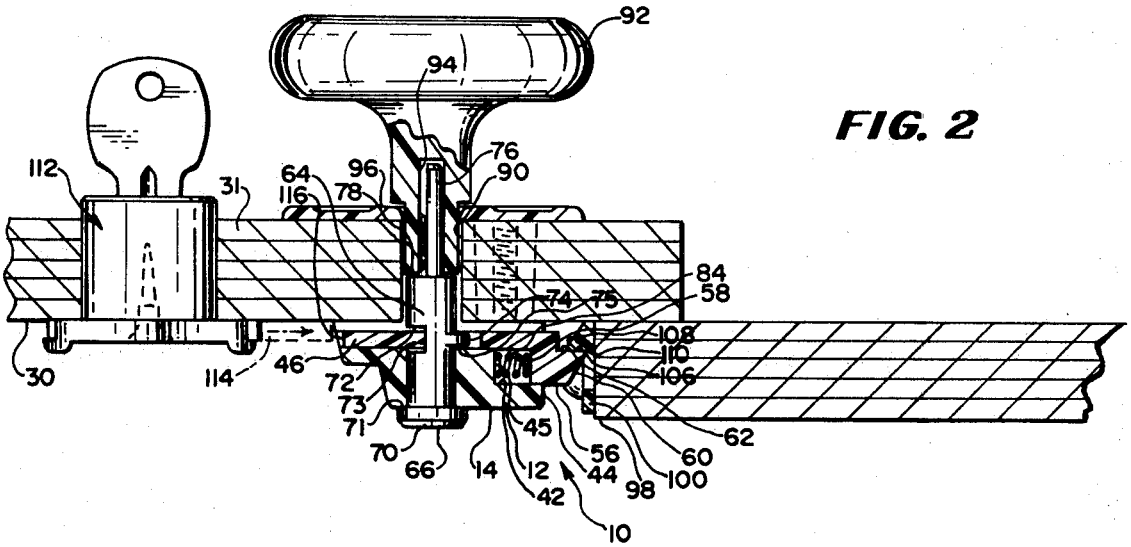
FIG. 2 is a sectional view taken along the line 2—2 of FIG. 1 in the direction indicated generally.
Figure 3:
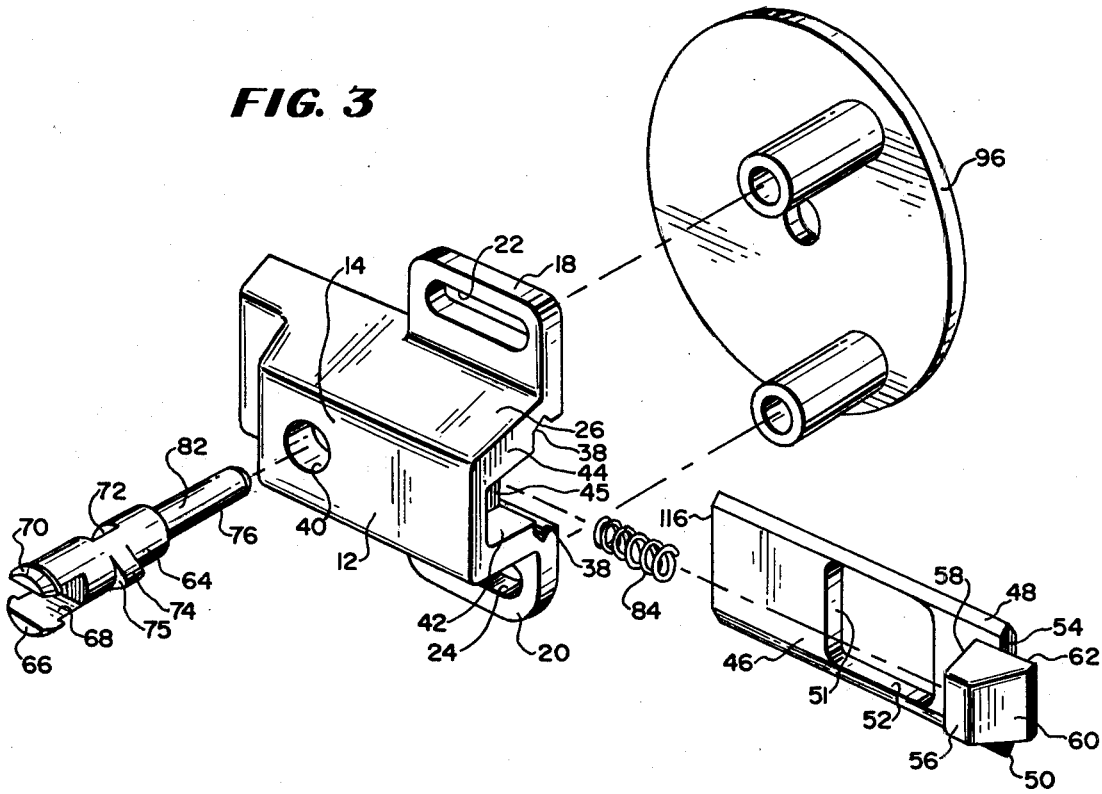
FIG. 3 is an exploded perspective view of the latch shown in FIG. 1.
Figure 4:
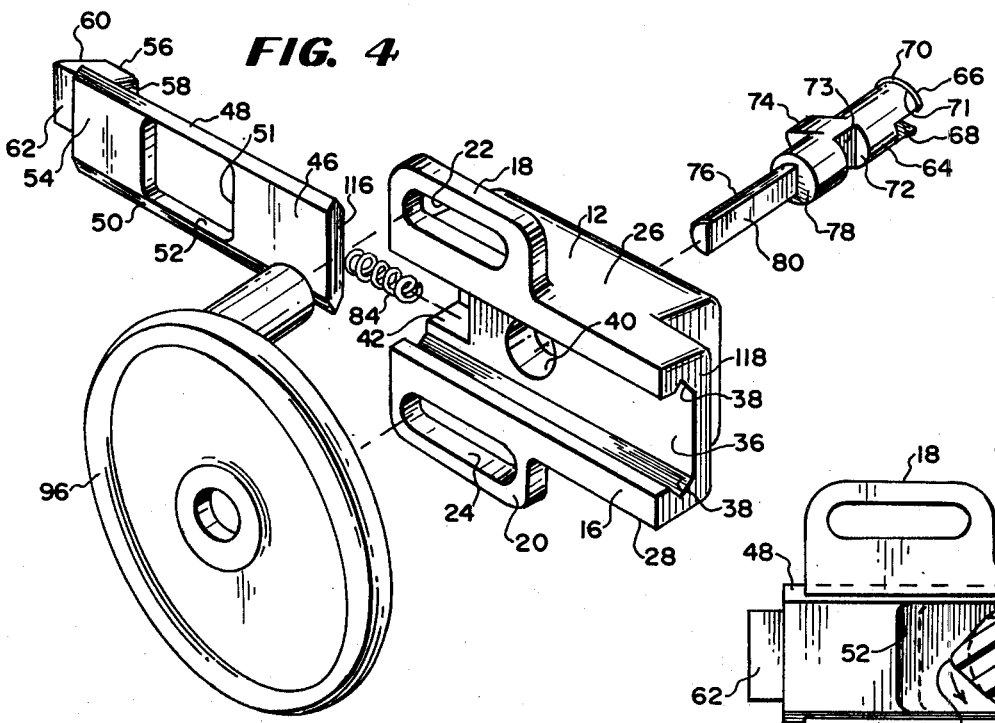
FIG. 4 is a view similar to FIG. 3 but illustrating the opposite sides of the elements seen in FIG. 3.
Figure 5:
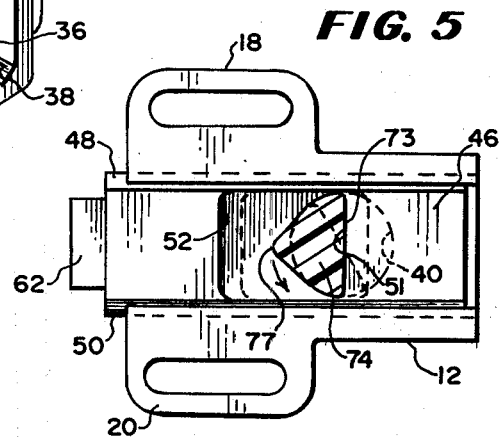
FIG. 5 is a plan view of the underside of the said latch in assembled condition.

Referring to FIGS. 1 through 5, the door latch of the invention indicated generally 10 includes a housing 12 and is formed preferably of molded plastic self-lubricating material. The housing 12 is of generally rectangular configuration with a top surface 14 and an undersurface 16. A pair of slotted ears 18, 20 with respective passageways 22, 24 are formed on opposite side surfaces 26, 28 of the housing 12 to enable attachment of the latch to a door surface 30 as shown in FIGS. 1 and 2. Suitable fasteners such as screws 32, 34 are provided for this purpose.

The undersurface 16 of the housing 12 has a channel 36 provided therein along the elongate dimension of the housing with grooved side walls 38 extending the length thereof. An aperture 40 passes through the housing opening at one end thereof to the top surface 14 and at the other end to the channel 36. A generally square-shaped compartment 42 is formed under the surface 14 of the housing and opens to the channel 36 and the front surface 44 of the housing. The compartment 42 has an abutment wall 45 formed at the rear thereof.

A latch engagement member 46 of generally rectangular configuration is provided for slidable receipt in the channel portion 36 of the housing 12. The engagement member 46 has substantially V-shaped tongues 48, 50 disposed along the elongate edges thereof for mating engagement with the grooves 38. The member 46 is formed with a generally square-shaped opening 52 proximate the center thereof and adapted to be in registry with the aperture 40 in the housing 12 when the member 46 is moved to a predetermined location in the channel 36.

The latch engagement member 46 has formed on one end 54 thereof a depending portion 56 of generally triangular configuration with a flat surface 58 and an inclined surface 60 formed on a wall opposite surface 58. The inclined surface 60 defines a flat engagement surface 62 formed normal with respect to the said flat surface 58.

The latch engagement member 46 is retained within channel 36 of housing 12 by retaining pin 64. Pin 64 is of generally shaft-like cylindrical configuration with an enlarged head portion 66 formed on one end and a longitudinal slot 68 provided therein and passing through the head 66. The head 66 has an inclined surface 70 and a lip 71 formed on the circumference thereof. Pin 64 also has radial slot 72 formed proximate the mid-point thereof with an axial dimension of approximately one-half the diameter of the pin 64. The bottom of slot 72 is defined by a wall 73. A generally V-shaped protrusion 74 having a flat surface 75 is formed on the pin on the surface thereof which is radially opposite the slot 72. A shaft 76 extends from the end 78 of the pin 64 opposite head 66 and has a flat surface 80 and a hemispherical surface 82.

The several elements of the door latch are assembled by first positioning the latch engagement member 46 within channel 36 after locating a helical spring 84 within compartment 42 so that the spring will be engaged against abutment wall 45 of the compartment. The latch engagement member 46 is moved to its position with depending portion 56 disposed within the compartment 42 such that spring 84 will be compressed between abutment wall 45 and flat surface 58 of the depending portion. The spring 84 therefore normally will bias depending portion 56 of latch engagement member 46 out of compartment 42.

When latch engagement member 46 is positioned with depending portion 56 within compartment 42, opening 52 in the member 46 will be in registry with aperture 40 in the housing 12. Retaining pin 64 is then positioned for assembly within aperture 40 by inserting the pin head part 66 through opening 52 such that inclined surface 70 rests against the opening of aperture 40 to channel 36. The pin then is forced into aperture 40 which causes head part 66 to contract by reason of slot 68; the pin is moved within the aperture until lip 72 clears the aperture and the head part snaps open. Lip 72 then abuts top surface 14 of the housing 12 and the flat surface 75 of the V-shaped protrusion 74 abuts the surface of channel 36. The radial orientation of pin 64 is such that one wall 51 of opening 52 is engaged within radial slot 72 abutting wall 73 thereof and V-shaped protrusion 74 has its apex part 77 facing the depending portion 56 of the latch engagement member 46 (see FIG. 5).

The assembled door latch 10 is positioned upon surface 30 of door 31 by fastening the latch against the surface with fasteners 32. Shaft 76 is positioned within passageway 90 provided in the door. A knob or other actuation member 92 having a blind-end passageway 94 is engaged upon shaft 76 in a known manner. A decorative plate 96 may be positioned between the knob and the door surface if desired. The jamb 98 against which the door 31 abuts when closed is provided with a striker plate 100 secured thereto by screws 102 passing through slots 104. The striker plate has a lip 106 with an inclined surface 108 and a flat engagement surface 110 against which the surface 62 of the member 46 may be engaged.

The door latch 10 is operable in the following manner. Assuming a door-open condition, when the same is moved to closed position the inclined surface 60 of latch engagement member 46 will operate against inclined surface 108 of striker plate 100 to move the member 46 against the force of spring 84 in channel 36. When the depending portion 56 clears the lip 106 of the striker plate, the spring 84 will cause member 46 to return to the latch locked condition illustrated in FIG. 2 with surface 62 engaged against surface 110 of the striker plate. To unlatch the door, the knob 92 is rotated approximately one-quarter turn to also rotate pin 64 approximately the same distance. Wall 51 of opening 52 thereupon is acted upon by wall 73 of slot 72 to move the depending portion 56 of member 46 into compartment 42 and thereby release the latch engagement member 46 from the striker plate 100. Pin 64 is prevented from being rotated more than approximately one-quarter turn by reason of protrusion 74, the apex 77 of which will abut a side wall of opening 52 to prevent further rotation.

A lock may be provided for operation in conjunction with the latch 10 to prevent unauthorized opening thereof. In FIGS. 1 and 2 one form of such a lock is illustrated. The lock 112 is of known construction having a key operable bolt 114. In the illustrations, the lock is positioned with the key-receiving portion opening to the surface of the door against which the knob 92 is disposed. The bolt 114 is positioned on the latch side 30 of the door and is movable between an unlocked position shown in solid line in the figures to a locked position shown in dotted outline. When in the unlocked position, the rear edge 116 of the latch engagement member 46 is unobstructed and may be operated as described above. When the lock bolt 114 is moved to the locked position shown in dotted outline, the same engages or nearly engages the rear side 118 of the housing 12 and blocks the channel 36 therein. Movement of the latch engagement member 46 in an attempt to release depending portion 56 thereby is prevented because the rear edge 116 thereof will abut the bolt 114.

Other forms of locking members may be used to achieve the same purpose as that described in connection with lock 112 described above. Referring to FIGS. 10 through 13, for example, a stop lock member 120 may be mounted directly upon the housing 12′ which is equivalent to housing 12 but formed with an extension portion 13 which also defines an extension of channel 36. Stop lock member 120 has a bifurcated shaft 122 with a short leg 124 and a longer leg 126 which is defined by a flat surface 128 and a hemispherical surface 130. The shaft 122 terminates with a collar 132; a handle 136 is provided to enable rotation of the shaft 122. The shaft 122 is rotatably force-fit in aperture 138 provided in extension portion 13 of the housing 12′ such that the shaft protrudes within channel 36 in the path of latch engagement member 46. The collar 132 prevents member 120 from passing completely through the aperture 138.

Stop lock member 120 is rotatable one-half turn within aperture 138 and is prevented from further rotation by stop pin 140 formed on collar 132 which will engage stop member 142 on the housing when the limit is reached. In a first or unlocked position of the stop lock member 120 illustrated in FIG. 10, the flat surface 128 of leg 126 faces the rear surface 116 of latch engagement member 46 and permits the member 46 to move toward the stop lock member 120. When the stop lock member 120 is rotated one-half turn (FIG. 12), the hemispherical surface 130 of leg 126 engages said rear surface 116 to prevent movement of the latch engagement member.

Figure 6:
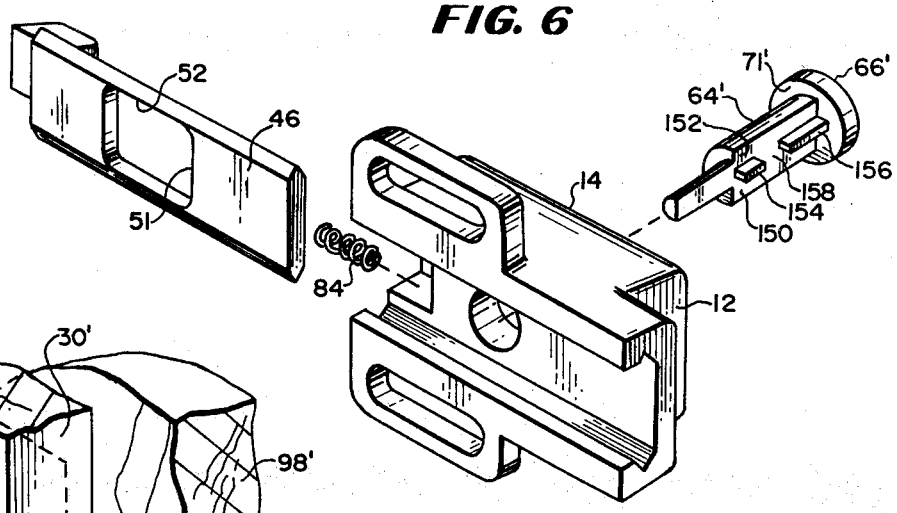
FIG. 6 is an exploded perspective view of an alternate embodiment of the invention.

The latch operating elements of retaining pin 64 also may be modified as shown in the alternate embodiment of FIG. 6. The housing 12 and latch engagement member 46 shown is the same as that previously described, but the pin 64' is formed without a longitudinal or radial slot therein as is the case with respective slots 68 and 72 of pin 64. Pin 64' has a solid head 66' and a hemispherical shank part 150 with a flat surface 152 upon which are formed a pair of upstanding walls 154, 156 defining a space 158 therebetween. The space 158 corresponds to radial slot 72 of pin 64 for actuation of the latch engagement member 46 by operation upon a back wall 51 of opening 52. Pin 64' is assembled together with member 46 and spring 84 within housing 12 in substantially the same manner previously described in connection with FIGS. 1 through 5 except pin 64' is inserted from the top surface side 14 of the housing. The undersurface 71' of head 66' rests upon the housing top side. Rotation of pin 64' will cause the wall 51 disposed within space 158 to ride against flat surface 152 and move the latch member 46 as previously described.

The door latch described thus far may be modified so as to be completely concealed as illustrated in FIGS. 7, 8, 9 and 9A. The concealed door latch 200 comprises a housing 210 which is of the same construction as housing 12 previously described. The latch engagement member 212 is similar to member 46 in that it has a depending portion 214 with an extension part 216 of generally triangular configuration with a flat surface 218 and an inclined surface 200 formed on a wall opposite surface 218. The inclined surface 220 defines a flat engagement surface 222 formed normal with respect to the said flat surface 218.

Latch engagement member 212 includes a lateral extension formation 224 of generally T-shaped configuration including a connecting part 226 joined to the body of member 212 normal with respect thereto, an arm part 228 generally parallel with the body of member 212, and a substantially flat actuation pad 230 formed on the arm part 228 normal with respect thereto. The actuation pad 230 presents a surface 232 against which a force may be exerted to move the latch engagement member against the force of spring 234 in compartment 42 of housing 210 and thereby release the latch from its engagement with striker pad 100 secured to door jamb 98'.

Latch engagement member 212 is retained within channel 235 of housing 210 by retaining pin 236 which is of generally shaft-like cylindrical configuration having an enlarged head portion 238 formed on one end. Formed on the end 240 of the member 212 opposite head portion 238 are a pair of legs 240, 242 each having a flat surface 244, 244' disposed in a common plane and a rounded surface 246, 246'. At the ends of the legs 240, 242 there is formed a respective lip part 248, 248' with an inclined surface 250, 250'.

Latch engagement member 212 is assembled within housing 210 by first positioning the member 212 in channel 235 with opening 254 aligned with aperture 256 of the housing. The inclined surfaces 250, 250' of lip parts 248, 248' are positioned at the opening of aperture 256 on top surface 258 of the housing and the retaining pin 236 is forced into the position shown in FIG. 8 with lips 248, 248' engaging the undersurface of the channel 235. In this position the flat surfaces 244, 244' of the legs 240, 242 engage against the wall 260 of opening 254 and prevent the latch engagement member from leaving its position in the channel 235.

During assembly in the housing of the pin 236 it is important that the same be orientated such that flat surfaces 244, 244' face wall 260 of opening 254. To ensure that this orientation is achieved a stop projection 262 may be formed on top surface 258 of the housing and a matingly engageable slot 264 can be cut from the head 238. Proper orientation is achieved when the projection 262 is positioned within the slot 264.

Figure 7:
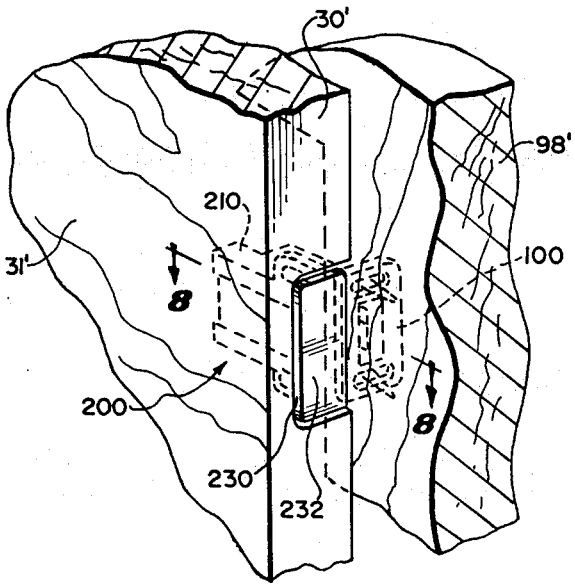
FIG. 7 is a perspective view illustrating another embodiment of the invention, this being a concealed door latch, the same being shown in installed condition on a door with parts thereof being illustrated in phantom outline.
Figure 8:
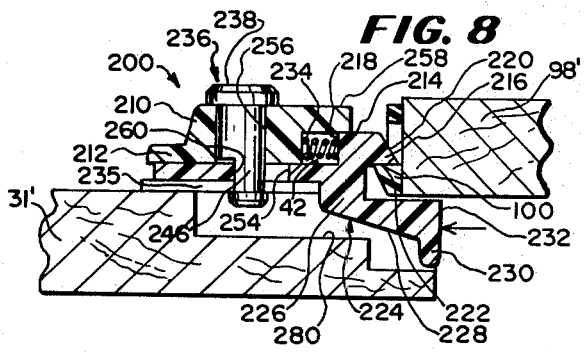
FIG. 8 is a sectional view taken along the line 8—8 of FIG. 7 in the direction indicated generally.
Figure 9:
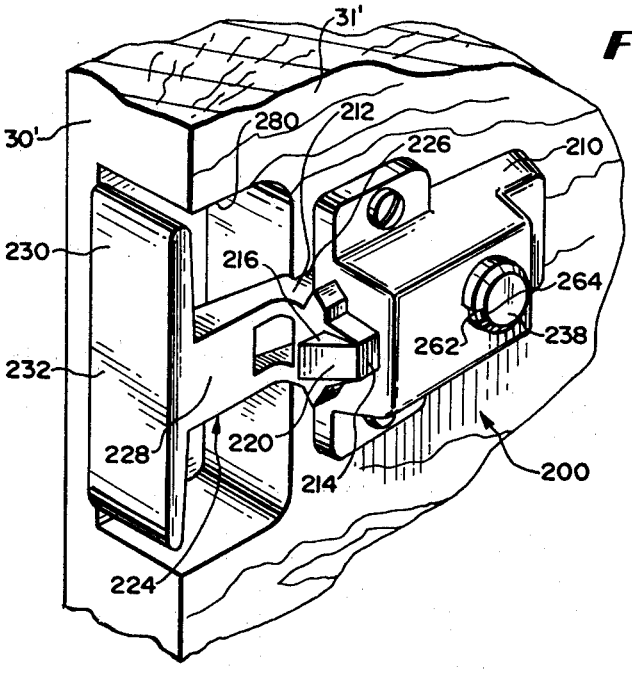
FIG. 9 is a perspective view of another side of the latch shown in FIGS. 7 and 8.
Figure 9A:
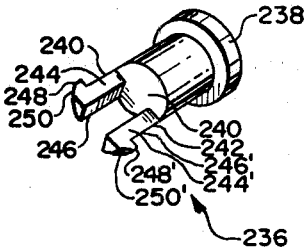
FIG. 9A is a perspective view of the retaining pin forming a part of the invention shown in FIGS. 7–9.
Figure 10:
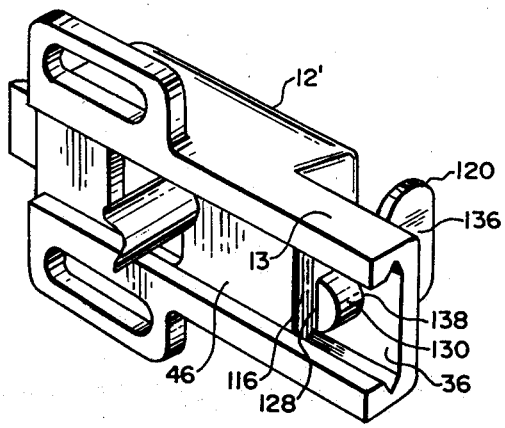
FIG. 10 is a perspective view of a still further alternate form of the invention showing the housing part thereof having a stop lock member positioned thereon.
Figure 11:
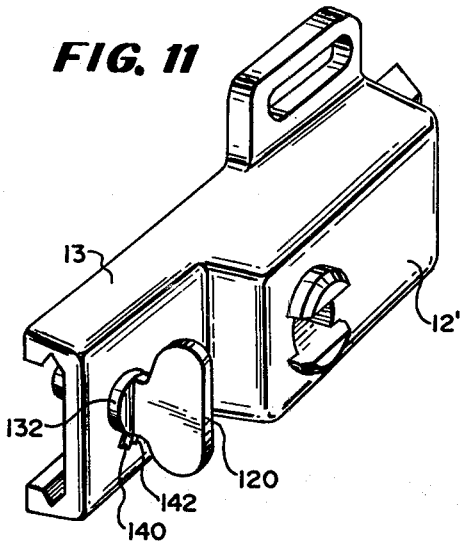
FIG. 11 is a view similar to FIG. 10 but illustrating the opposite side of the housing and associated elements.
Figure 12:
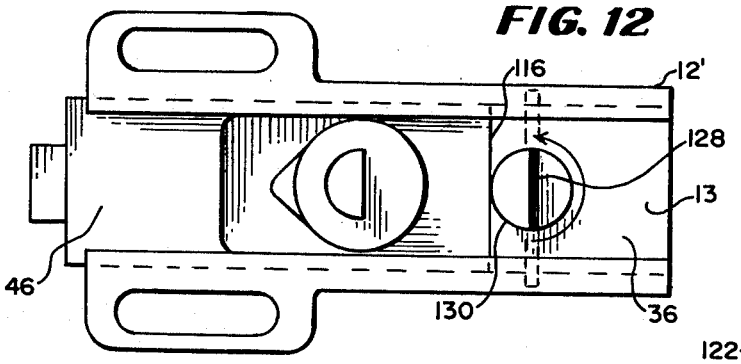
FIG. 12 is a plan view of the underside of the latch illustrated in FIGS. 10 and 11.
Figure 13:
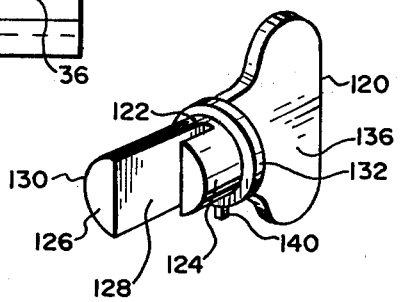
FIG. 13 is a perspective view of the stop lock member of FIG. 10.

The assembled latch 210 is secured to door 31' within which a channel 280 has been cut to receive the lateral extension formation 224. When positioned as shown in FIGS. 7–9, the surface 232 of extension 224 preferably is disposed flush with the edge 30' of the door. Thus, when the door is closed and latched, no portions of the latch or the actuating means therefor project beyond any surfaces of the door or jamb. To unlatch the door 31' the user pushes his finger against the surface 232 which releases the latch engagement member 212 from the striker plate 100.

It should be understood that either of the lock means 112, 120 as disclosed in connection with the embodiments previously described could be used in connection with the concealed latch 200.

Figure 14:
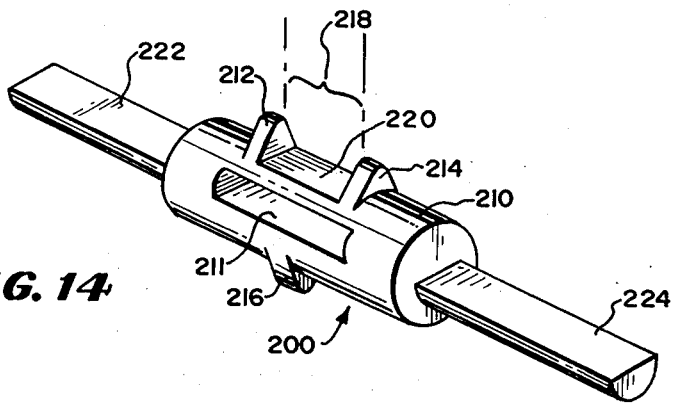
FIG. 14 is a perspective view of a modified form of the retaining pin forming a part of the invention.

Minor variations in the structure and other variations in the arrangement and size of the various parts of the disclosed embodiments may occur to those skilled in the art without departing from the spirit or circumventing the scope of the invention. For instance, any of the embodiments described could be modified to be operable from both sides of a door. Referring to FIG. 14, a retaining pin 200 is shown which may be utilized with any of the door latches 10 or 200 disclosed to render the same operable from either side of a door upon which the latches are mounted.

The pin 200 comprises a central cylindrical portion 210 with a longitudinal slot 211 therein on either side of which are formed generally V-shaped projections 212, 214 and 216. The projections 212 and 214 define a space 218 therebetween within which flat surface 220 of the cylindrical portion 210 is disposed. A respective shank 222, 224 is formed on either end of the cylindrical portion 210.

The pin 200 could be installed in latch housing 12, for example, in lieu of pin 64. In installation, pin 200 is inserted through aperture 40 by compressing the cylindrical part 210 proximate slot 211. When installed, the surface 220 between projections 212, 214 corresponds to surface 73 of pin 64 and performs the same operational functions. The projection 216 corresponds with projection 74 to serve as a stop member to prevent over-rotation of the pin. A respective knob (not shown) is positioned on shanks 222, 224 and the latch thereby will be operational from either side of the door upon which the latch having pin 200 is installed.

What is claimed and desired to be secured by Letters Patent of the United States is:

1. A door latch for latching a door to its associated jamb, the door having a channel therein opening to an edge surface thereof, said latch comprising, a housing of generally rectangular configuration with a top surface and an undersurface and being mountable on one surface of the door overlying said channel with the undersurface facing said one surface of the door, a channel formed in the undersurface along the elongate dimension of the housing, a latch engagement member having an opening formed therein and retained within the housing, cooperative means on said channel and said latch engagement member to permit slidable movement of the latch engagement member in the channel, means on the latch engagement member for cooperative engagement with a striker plate mounted on the jamb, an aperture passing through the housing and opening at one end thereof to the top surface and at the other end thereof to the channel in the housing, a retaining pin positioned through the aperture in the housing and the opening in the latch engagement member, spring means positioned in the housing to bias the latch engagement member so that at least a portion of said latch engagement member normally is disposed out of the housing and engaged with the striker plate, said retaining pin having a flat surface thereon engaged against one wall of the opening in the latch engagement member to prevent the latch engagement member from leaving the housing, the latch engagement member including a lateral extension disposed within the door channel and terminating proximate the edge surface of the door so as to be substantially flush therewith, said extension being operable upon exertion of a force thereagainst to move the latch engagement member against the force of the spring means and thereby disengage the member from the striker plate to permit unlatching of the door, and including a generally square-shaped compartment formed in the housing beneath the top surface, said compartment opening to a front surface of the housing and to the channel in the housing, and an abutment wall formed in the compartment on a side thereof opposite the front surface of the housing, said spring means being located in said square-shaped compartment and acting against said abutment wall.

2. A door latch as claimed in claim 1 in which said cooperative means on said channel and said latch engagement member comprise grooved side walls of said channel extending the length thereof and generally V-shaped tongues disposed along the elongate edges of said latch engagement member.

3. A door latch as claimed in claim 1 in which the opening formed in the latch engagement member is generally square-shaped and is located proximate the center of the elongate dimension of the latch engagement member, the latch engagement member being adapted to be moved in the housing such that the opening is in registry with the aperture.

4. A door latch as claimed in claim 3 in which the latch engagement member has a depending portion formed on one end thereof, the depending portion being of generally triangular configuration with a first flat surface and an inclined surface formed on a wall opposite said first flat surface, a flat engagement surface formed normal with respect to said first flat surface, said first flat surface being adapted for cooperative engagement with a flat surface of the striker plate.

5. A door latch as claimed in claim 1 in which the latch is formed of self-lubricating molded plastic material.

6. A door latch as claimed in claim 1 in which the housing has a rear surface and the channel opens thereto, the latch engagement member being movable to a position in which an abutment end thereof projects beyond the channel opening to the rear surface, said latch including means to prevent unauthorized unlatching of the door, said last named means comprising an abutment member positioned adjacent the rear surface of the housing and movable between a first position blocking the channel opening to the rear surface and a second position clear of the channel opening to the rear surface.

7. A door latch as claimed in claim 6 in which the abutment member is the bolt of a key actuated lock.

8. A door latch as claimed in claim 1 in which the retaining pin is of generally cylindrical configuration having an enlarged head portion, said flat surface being defined by at least one upstanding wall on the retaining pin.

9. A door latch as claimed in claim 8 in which the retaining pin has a pair of leg portions extending from a flat end thereof opposite the end having the head portion, the leg portions having common planar faces extending from said flat end and defining said flat surface.

10. A door latch as claimed in claim 9 in which a stop projection is formed on the top surface of the housing and the head has a slot for mating engagement with said stop projection.

11. A door latch as claimed in claim 1 in which the lateral extension is of generally T-shaped configuration with an arm cojoined to the latch engagement member and a substantially flat actuation pad formed on the arm normal with respect thereto, one surface of said pad being disposed in the plane of the door edge.

* * * * *